United States Patent [19]

Bigotte

[11] Patent Number: 4,591,079

[45] Date of Patent: May 27, 1986

[54] CONTAINER CAP WITH SELF-RETRACTING SPOUT

[76] Inventor: Georges Bigotte, 11, Quai Paul Doumer, 92400 Courbevoie, France

[21] Appl. No.: 628,560

[22] Filed: Jul. 6, 1984

[30] Foreign Application Priority Data

Jul. 8, 1983 [FR] France ..... 83 11456

[51] Int. Cl.[4] ..... B65D 47/10

[52] U.S. Cl. ..... 222/538; 222/505

[58] Field of Search ..... 222/526, 537, 531, 538, 222/539, 505, 559, 561, 544, 206, 212, 42, 507, 508, 509

[56] References Cited

U.S. PATENT DOCUMENTS 3,847,313 11/1974 Micallef ..... 222/538

FOREIGN PATENT DOCUMENTS 2088838 6/1982 United Kingdom .

2112761 7/1983 United Kingdom .

*Primary Examiner*—Joseph J. Rolla

*Assistant Examiner*—Kenneth Noland

*Attorney, Agent, or Firm*—Blum Kaplan Friedman Silberman & Beran

[57] ABSTRACT

A closing cap with a self-retracting spout, the cap comprising: a cylindrical cap body having in its top a central keyway diametrically crossing the top and of rectangular section, one end of the keyway being closed off and the cap body having a center opening; a spout having a vertical drive pin, the spout comprising a flow channel and being operable to slide in the central keyway; and a revolving cover having a window, and a specially configured guiding ramp located towards the front of the cover, the ramp cooperating with the drive pin of the spout in the central keyway as the cover is rotated.

5 Claims, 12 Drawing Figures

CONTAINER CAP WITH SELF-RETRACTING SPOUT

This invention concerns a closing cap with a self-retracting spout for containers such as plastic, glass or metal tubes or bottles.

Plastic tubes are generally provided with closures such as screw caps which are removed to open the tube, nonremovable, tamper-proof caps with vertical end pieces designed to be cut off and sometimes recapped, or dispensing closures.

The term "dispensing closure" as used herein designates closures which are integrally fitted to the tube body, are not removed to open the tube and require a minimum amount of manipulation. Dispensing closures of this type for example include articulable-lever caps, caps with hinged covers and caps with an offset communicating hole on their surface.

This invention provides a new "dispensing"-type closure enabling the pour spout thereof to be automatically extended and retracted.

The container cap according to the invention consists of three basic parts, as follows:

a cylindrical cap body having in its top a central keyway, with one end of said keyway closed off;

a spout having a vertical driving pin, said spout being operable to slide in said central keyway;

and a revolving cover having a specially configured guiding ramp which cooperates with the vertical pin of the spout as said cover is rotated.

The cap according to the invention will now be described in greater detail with reference to the appended drawings in which.

FIGS. 9*a–d* illustrates the kinematics of operation of a cap according to the invention.

DETAILED DESCRIPTION OF THE PREFERRED EMBODIMENT

Figure 1:
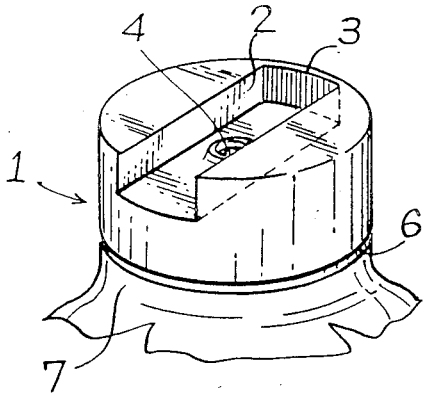
FIG. 1 shows the body of the cylindrical cap.
Figure 2:
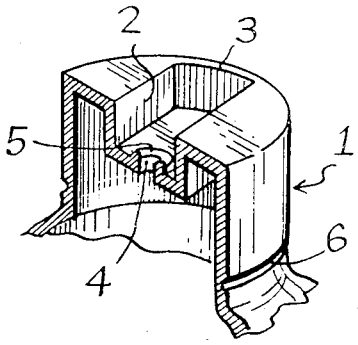
FIG. 2 shows an axial cross section of said cap.

The cap body 1 shown in FIGS. 1 and 2 is cylindrically shaped and is provided with a center keyway 2 diametrically crossing the top of said cap body and having a rectangular section. One of the ends 3 of the top keyway is closed off. Given the cylindrical shape of the cap body, said center keyway is substantially "U-shaped".

The cap body further includes an opening or outlet hole 4 allowing product in the capped container to flow out therethrough.

Said hole 4 is located at the center of the cap body 1 and is advantageously provided with a sealing bush 5. The cap body 1 also includes means for fastening or catching the cover, said means consisting for example of a circular groove 6 preferably provided in the lower portion of the cap body.

The cap body 1 of the closure according to the invention is adapted to the container for which it is provided; for example, it may consist of the collar of a tube 7, as shown for purposes of illustration in the appended drawings. It could alternatively be a multipurpose cap for glass bottles or metal containers, said cap being made integral or not with said container.

Figure 3:
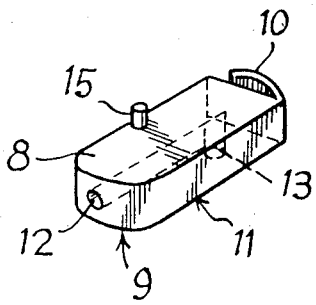
FIG. 3 shows the spout.
Figure 4:
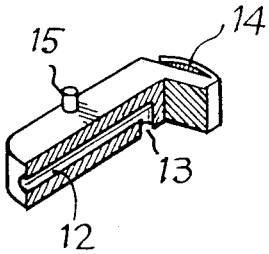
FIG. 4 is a cutaway view of said spout, taken axially.

The spout, which is another feature of the cap according to the invention is depicted in FIGS. 3 and 4. Said spout is shaped as a rectangular prism 8 the two ends 9 and 10 of which are rounded and which will be referred to in the continuation of this description respectively as the front 9 and the back 10 of the spout. Said prism is sized to fit snugly into said keyway 2 of the cap body, the sides of said prism being given guiding means 11, such as guiding strips or rings for example. An outlet channel 12 and 13 for the product in the container fitted with the cap according to the invention is provided through the inside of said spout. Said channel consists of two parts: part 12 going through the prism longitudinally from the front 9 of the spout to part 13 running normal thereto and located near the back 10 of the spout and terminating at the bottom face of said spout. The back 10 of the spout is advantageously hollowed out to serve as a leaf spring 14. On the top of the spout is a vertical pin 15. The relative position of said vertical pin 15 and of the orifice of part 13 will be specified hereinafter in the description of the closure's operation.

Figure 5:
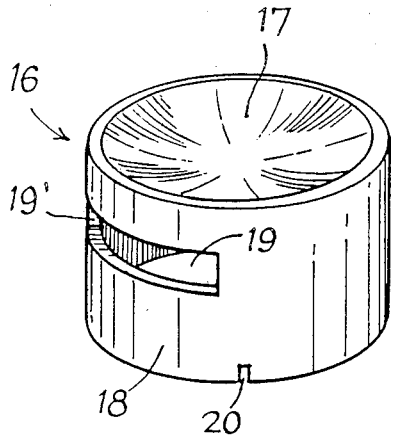
FIGS. 5 and 6 show the cover, FIG. 6 being a broken-out section of the cover.
Figure 6:
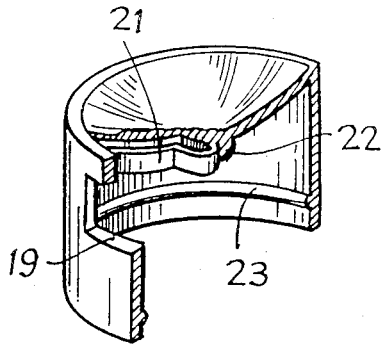

The cover 16, the third basic part of the closure according to the invention, is depicted in FIGS. 5 and 6. It consists of a center plate 17 and a cylindrical skirt 18, said skirt having a window 19 allowing passage of the spout when extended for use. Said window can be provided with a removable tamper-proof sealing tab. Said window is therefore slightly larger than the spout in their vertical dimensions and approximately the width of a quarter of the circumference of the cover. Said skirt 18 also has a slot 20 in its bottom edge. Said slot 20, provided for the purpose of fitting the cover to the cap body, must not be located beneath the window 19.

The inside of the cover is provided with locking or catching means 23, in the form for example of a projection or rib being suitable to engage with the groove 6 in the cap body and a stud operable to fit snugly against the front opening of the spout.

The inside portion of the center plate 17 is advantageously given a convex form and the center thereof is provided with a nipple 22 directed toward the inside of the cover, while the front portion thereof is provided with a guiding ramp 21 having a specific shape which cooperates with the vertical pin on the spout to slidably drive said spout.

The designation "front portion" means that part of the center plate which lies above the cutout window 19 in the cover skirt 18.

Figure 7:
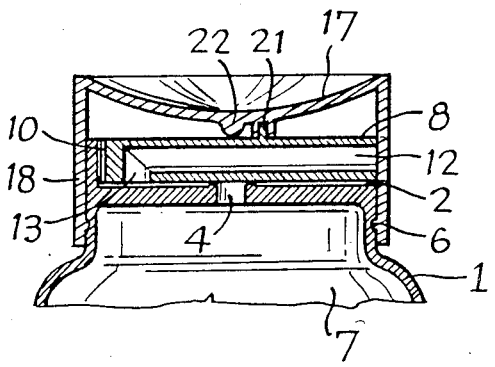
FIGS. 7 and 8 show the cap according to the invention fitted on a tube.
Figure 8:
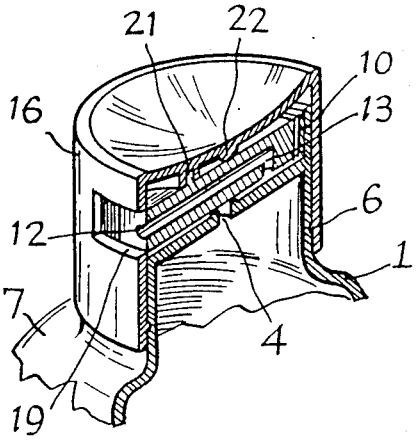

The closure system as a whole according to the invention fitted to a tube is depicted in FIGS. 7 and 8, in which like parts bear the same references as in the previous figures.

The guiding ramp 21, part of the center plate 17, is given a specific shape for the purpose of driving the extension and retraction of the spout 8 through the cover window 19 by rotation of said cover, by a quarter turn, for example. Said ramp 21 extends from the periphery of the cover to the center of same, its length being related to the width of the window. The shape of the ramp is defined hereinafter in terms of its function of guiding the spout, said function being firstly to clear a path for said spout, then to thrust said spout forward during opening of the closure system. Said ramp is shaped so that at the beginning of cover rotation, the spout remains stationary in the center keyway 2, until the front 9 of the spout becomes fully visible in the window 19; thereafter, the shape of the guiding ramp is suitable to enable the thrusting out of the spout through said window 19 up to the point where the opening in the channel 13 aligns with container and cap body outlet 4, at which time the vertical pin 15 has reached the periphery of cover 16.

Referring now to FIG. 9, a preferred embodiment of the guiding ramp 21 is illustrated in four diagrams showing the operation of the closure according to the invention in quarter-rotational steps of the cover.

Figure 9A:
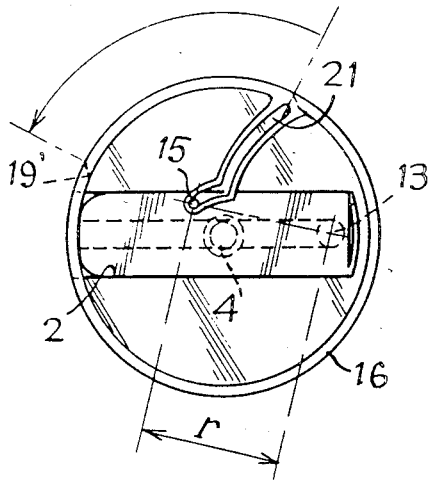
Figure 9B:
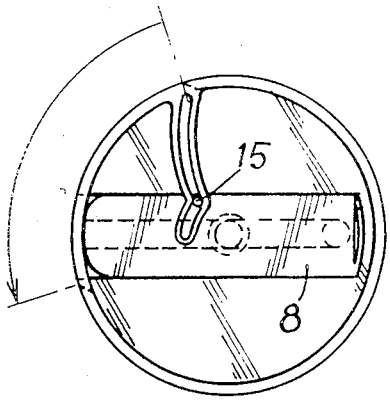
Figure 9C:
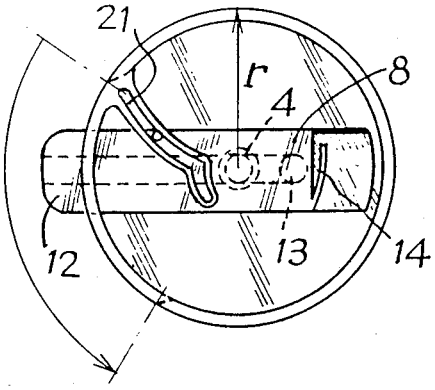
Figure 9D:
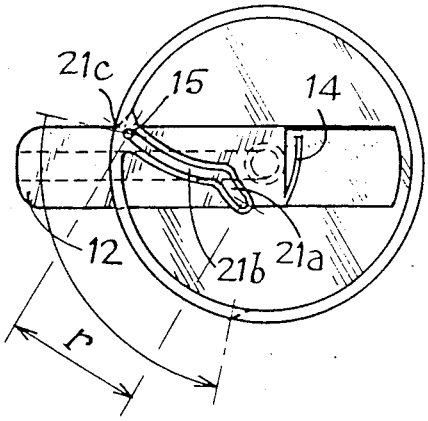

FIGS. 9*a* and 9*d* show the closure system respectively in its "closed" and "opened" positions and FIGS. 9*b* and 9*c* show intermediate steps between full opening and closing.

In this preferred embodiment, mentioned as a nonlimiting example, the distance between the vertical pin 15 and the opening of channel 13 and the distance between the two ends of ramp 21 are both substantially equal to the internal radius "r" of the cover 16. In closed position (FIG. 9*a*), the vertical pin 15 is aligned with both the opening in channel 13 and the edge 19' of the window.

The guiding ramp 21, as shown in FIG. 9, consists of two parts 21*a* and 21*b*. Part 21*a* cooperates with vertical drive pin 15 to hold the spout stationary until the front 9 of same becomes completely visible through window 19 as cover 16 rotates. Said part 21*a* is shaped substantially as a circular arc whose center is the opening 4 and whose radius is the distance between opening 4 and vertical pin 15 when the spout is entirely within keyway 2, in other words in the closed configuration (FIG. 9*a*). Thereafter, as one continues to rotate the cover, part 21*b* of the ramp cooperates with pin 15 to slidably thrust spout 8 out of keyway 2. The preferred shape for said part 21*b*, depicted in FIG. 9, is a circular arc of radius "r" going through the center of the cap body.

To assemble the three basic parts of the closure system according to the invention, the spout 8 must be positioned in the keyway 2 of the cap body; the cover 16 in closed position is snapped onto said cap body 1. The slot 20 provided in the cover skirt enables a mechanical finger to keep the spout in the keyway 2 prior to fitting the cover; when the mechanical finger is withdrawn, the sliding spout is locked inside the cover. The sliding spout presses against the inside wall of the cover due to the action of the rear leaf spring 14. A slight play between the ramp and the pin allows the pressure to be varied. The spout outlet or mouth mates with the stud on the cover's inside wall.

In the embodiment illustrated in FIG. 9, the spout is brought to dispensing position outside the cover by imparting to the cover a quarter turn unscrewing motion. By giving the cover a quarter turn screwing motion, the spout retracts beneath the cover. The spout is driven by rotation of the cover, since the vertical drive pin 15 is engaged in the cover's guiding ramp.

In the closed configuration illustrated in FIG. 9*a*, the container and cap body outlet 4 is not aligned with the spout channel opening 13 and tightness is provided by the sealing bush 5.

In the open configuration illustrated in FIG. 9*d*, the container and cap body outlet 4 is aligned with the spout channel opening 13, allowing the product to flow out.

Tightness is provided by the bush 5 surrounding the container to cap body outlet applying against the bottom of the spout channel opening or inlet 13.

The center nipple on the inside of the cover provides the necessary pressures for tightness during the opening and closing motions.

As previously mentioned, the back 10 of the spout is hollowed out to act as a leaf spring 14 imparting a pressure of the movable spout against the inside wall of the cover, said pressure able to be varied thanks to the slight play between the guiding ramp and the drive pin.

The different parts of the closure system according to the invention can be made of the same material, in the case for example of a plastic tube or squeeze bottle, or of different materials such as a metal. In any case, the material of the spout must necessarily be inert with respect to the substance contained in the container. All of the parts moreover can be suitably and favorably made by casting, injection molding or machining.

The closure means according to the invention provides automatic extension and retraction of the spout, both done horizontally. In use, the spout projects substantially beyond the outside of the tube thus avoiding spillage or dripping onto the packaging.

When not in use, the spout retracts inside the cover and is thus protected from outside contamination. During retraction, the wiping of the spout against the cover wall ensures its self-cleaning, thus enabling the removal of sand, for example, in the case of containers for sunbathing lotions.

What is claimed is:

1. A closing cap with a self-retracting spout, for use with a container, said cap comprising:

a cylindrical cap body having in its top a central keyway diametrically crossing said top and of rectangular section, one end of said keyway being closed off and the cap body having a center opening;

a spout having a vertical drive pin, said spout comprising a flow channel and being operable to slide in said central keyway;

said spout being shaped as a rectangular prism the two ends thereof being rounded and the sides thereof being provided with guiding means, said spout containing an internal channel consisting of two sections, one section going longitudinally through the prism from the front to the second section perpendicular thereto and located at the back of said spout and terminating at the bottom face of said spout;

and a revolving cover having a window, and a specially configured guiding ramp located towards the front of said cover, said ramp cooperating with said drive pin of the spout in the central keyway as said cover is rotated;

said cover and said cap body having catching means for locking the cover onto the cap body, and the flow channel of said spout being so designed that the inlet to the channel aligns with the outlet from a container when in use position;

wherein the back of said spout is hollowed out to form a leaf spring.

2. A closing cap with a self-retracting spout, said cap comprising:

a cylindrical cap body having in its top a central keyway diametrically crossing said top end of rectangular section; one end of said keyway being closed off and the cap body having a center opening;

a spout having a vertical drive pin, said spout comprising a flow channel and being operable to slide in said central keyway;

said spout being shaped as a rectangular prism the two ends thereof being rounded and the sides thereof being provided with guiding means, said spout containing an internal channel consisting of two sections, one section going longitudinally through the prism from the front to the second section perpendicular thereto and located at the back of said spout and terminating at the bottom face of said spout;

and a revolving cover having a window, and a specially configured guiding ramp located towards the front of said cover, said ramp cooperating with said drive pin of the spout in the central keyway as said cover is rotated;

wherein said guiding ramp is an internal part of the center plate of the cover, extending from the periphery of the cover to the center of the cover, said ramp being shaped so that by cooperating with the drive pin on the spout when the cover is rotated, the spout at first remains stationary in said keyway, until the front of said spout is entirely visible through said window, and thereafer slides out beyond the keyway until said channel inlet aligns with the cap body and a container outlet;

said cover and said cap body having catching means for locking the cover onto the cap body, and the flow channel of said spout being so designed that the inlet to the channel aligns with the outlet from a container when in use position.

3. A cap as in claim 2, wherein the distance between the two ends of the cover ramp and the distance between the drive pin and the spout inlet are both substantially equal to the radius of the cover.

4. A cap as in claim 3, wherein the inside of the cover plate is provided with a center nipple directed to the inside of said cover.

5. A cap as in claim 4, wherein the container outlet through the cap body is provided with a sealing bush.

* * * * *